US009015875B2

(12) United States Patent
Pridemore

(10) Patent No.: US 9,015,875 B2
(45) Date of Patent: Apr. 28, 2015

(54) CLAMPING DEVICE, SYSTEMS, AND METHODS

(76) Inventor: Kevin Pridemore, Nixa, MO (US)

( * ) Notice: Subject to any disclaimer, the term of this patent is extended or adjusted under 35 U.S.C. 154(b) by 593 days.

(21) Appl. No.: 13/493,973

(22) Filed: Jun. 11, 2012

(65) Prior Publication Data

US 2012/0311780 A1 Dec. 13, 2012

Related U.S. Application Data

(60) Provisional application No. 61/495,767, filed on Jun. 10, 2011.

(51) Int. Cl.
*E03C 1/33* (2006.01)

(52) U.S. Cl.
CPC ..... *E03C 1/33* (2013.01); *Y10T 29/49826* (2015.01)

(58) Field of Classification Search
CPC ..... E03C 1/33; E03C 1/335
USPC ..... 4/633, 634
See application file for complete search history.

(56) References Cited

U.S. PATENT DOCUMENTS

| | | | | |
|---|---|---|---|---|
| 3,365,732 | A * | 1/1968 | Juergens et al. | 4/634 |
| 4,432,106 | A * | 2/1984 | Smith | 4/633 |
| 6,986,174 | B2 | 1/2006 | Brown | |
| 2006/0218723 | A1 * | 10/2006 | Schneider et al. | 4/631 |
| 2009/0307881 | A1 | 12/2009 | Davey | |
| 2014/0223700 | A1 * | 8/2014 | da Silva | 24/457 |
| 2015/0059084 | * | 3/2015 | Hocaoglu | 4/633 |

* cited by examiner

*Primary Examiner* — Huyen Le
(74) *Attorney, Agent, or Firm* — Lathrop & Gage LLP

(57) ABSTRACT

A clamping device for mounting a sink to a counter, includes a clamp having a clamp body and a binding tab, a binding post for insertion through a first opening in the clamp body and into a hole in a surface of the sink adjacent to a clamped article, the clamp and binding tab connected to the post and extending away therefrom at least partially over an edge of the clamped article, and a clamp screw for insertion through a second opening in the clamp body and against a solid portion of the binding tab interposed between the clamp screw and the edge of the clamped article.

18 Claims, 6 Drawing Sheets

CLAMPING DEVICE, SYSTEMS, AND METHODS

RELATED APPLICATIONS

This application claims the benefit of priority of U.S. Provisional Application Ser. No. 61/495,767, filed Jun. 10, 2011, incorporated herein by reference.

BACKGROUND

The present invention relates to the countertop industry. More particularly, the present invention relates to mounting sinks to counters and countertops.

Conventional methods of and systems for attaching an undercounter sink to the underneath side of a counter, especially when the counter is made of granite or another hard surface, are time consuming and often subject to failure due to human error. In one conventional system, a sink is attached to a counter using clips, typically supplied with the sink, that require drilling into the hard surface of the counter with an oversize diamond drill, inserting a threaded insert into the hole drilled therein utilizing a two-part epoxy, and then attaching the sink to the threaded insert with a screw and a clip to clamp the sink into place. This conventional system is time-consuming to install, and overtightening of the screw may cause the insert to pull out of the counter, while attaching the screw and the clip in the confined space under the counter is often difficult.

Another conventional system requires undercutting a slot into the hard material of the countertop and then inserting a special fastener into the slot. The sink is fit over the fastener, and then a clip and nut are required to clamp the sink to the countertop by the fastener. This system creates a strong clamping of the sink, but is also difficult and time-consuming to implement, while the equipment necessary to cut the slot is also expensive.

In another conventional system, special studs are glued to the underside of the countertop using a two-part epoxy, and the sink is held to the counter by tightening a clip and nut to the studs similar to the systems described above. In this system, the sink is directly attached to the counter only by gluing means, which creates reliability problems. Implementation of this system is also difficult to perform in confined spaces, such as when the countertop is attached to the counter prior to installation of the sink Another known method is to build a wooden cradle under the countertop for the sink to rest upon. In addition to being labor-intensive, this method typically renders the sink non-removable from the countertop.

A similar conventional method is to hang the sink on a wire sling attached to the base of the counter cabinet. This method, however, is also very time-consuming to implement, and difficult to standardize among sinks and cabinets of varying size.

A still further method of attaching a sink to a granite or stone countertop requires first cutting slots into the underside of the countertop to accept "L" shaped spring clips. Such spring clips, however, usually require at least two pieces, and must be hammered into place, which is very difficult in the confined space under the sink. This method is costly, and moreover, the required hammering action risks damaging the sink and countertop material. Additionally, extreme care must be taken when cutting the slots, which must be perpendicular to the surface of the countertop, or the countertop could be mined.

SUMMARY OF THE INVENTION

The present clamping device, system, and methods allow for an advantageous quick and easy attachment of a sink to a surface of a counter.

In an embodiment, a clamping device for mounting a sink to a counter, includes a clamp having a clamp body and a binding tab, a binding post for insertion through a first opening in the clamp body and into a hole in a surface of the counter adjacent to a clamped article, the clamp body and binding tab connected to the post and extending away therefrom at least partially over an edge of the clamped article, and a clamp screw for insertion through a second opening in the clamp body and against a solid portion of the binding tab interposed between the clamp screw and the edge of the clamped article.

In an embodiment, a counter system includes a countertop, a sink configured to fit with an opening of the countertop, and a clamping device for attaching the sink to the countertop. The clamping device includes a clamp including a first opening and a second opening along a lengthwise direction of the clamp separate from one another, a binding post for insertion through the first opening and into a hole in a surface of the countertop adjacent to the sink, and a clamp screw for insertion through the second opening in the clamp and against the edge of the sink.

In an embodiment, a method of installing a sink to a countertop includes the steps of forming an opening in the countertop corresponding to a shape of an outer edge of the sink, the opening being smaller than a perimeter of the outer edge of the sink, positioning the sink about the opening in the countertop, drilling a plurality of holes at least partially through a thickness the countertop, the plurality of holes located adjacent to but outside of the perimeter of the outer edge of the sink, locating a respective first open portion of a first end of each of a plurality of clamps about each of the plurality of holes, inserting a binding post through each clamp first end open portion and respective hole to hold the sink against the countertop, threading a plurality of clamp screws into a respective second open portion of each of the plurality of clamps, each of the second open portions being disposed on the outer edge of the sink, and tightening each of the plurality of clamp screws against the outer edge of the sink to securely install the sink against the countertop.

DETAILED DESCRIPTION OF THE FIGURES

Figure 1A:
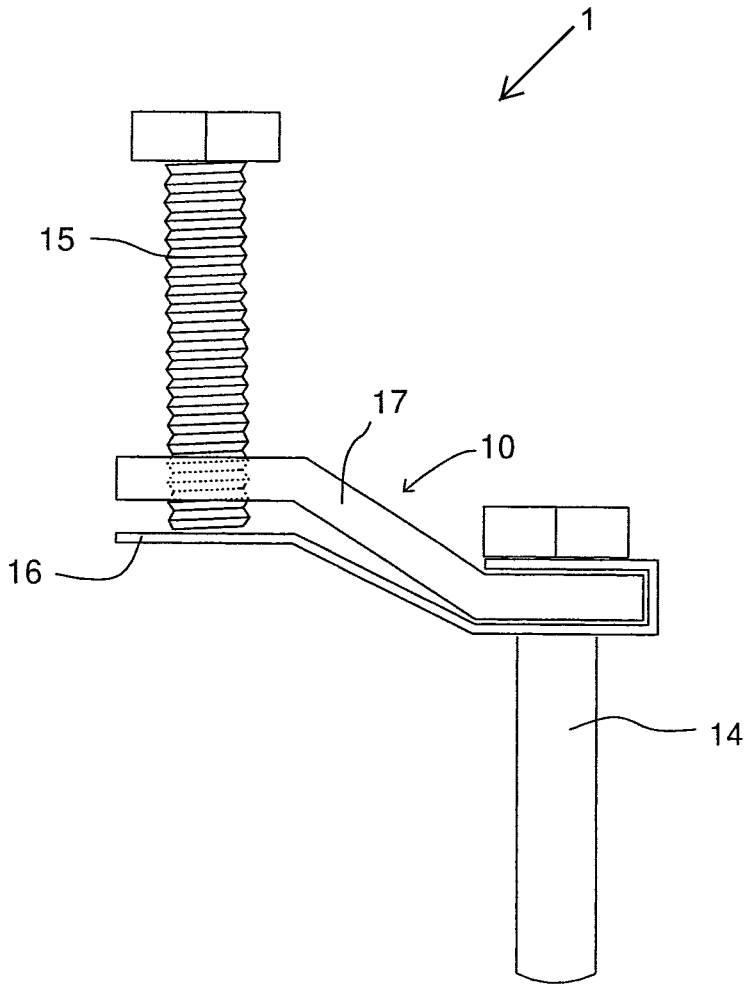
FIGS. 1A and 1B are side views of a clamping device, according to an embodiment.
Figure 1B:
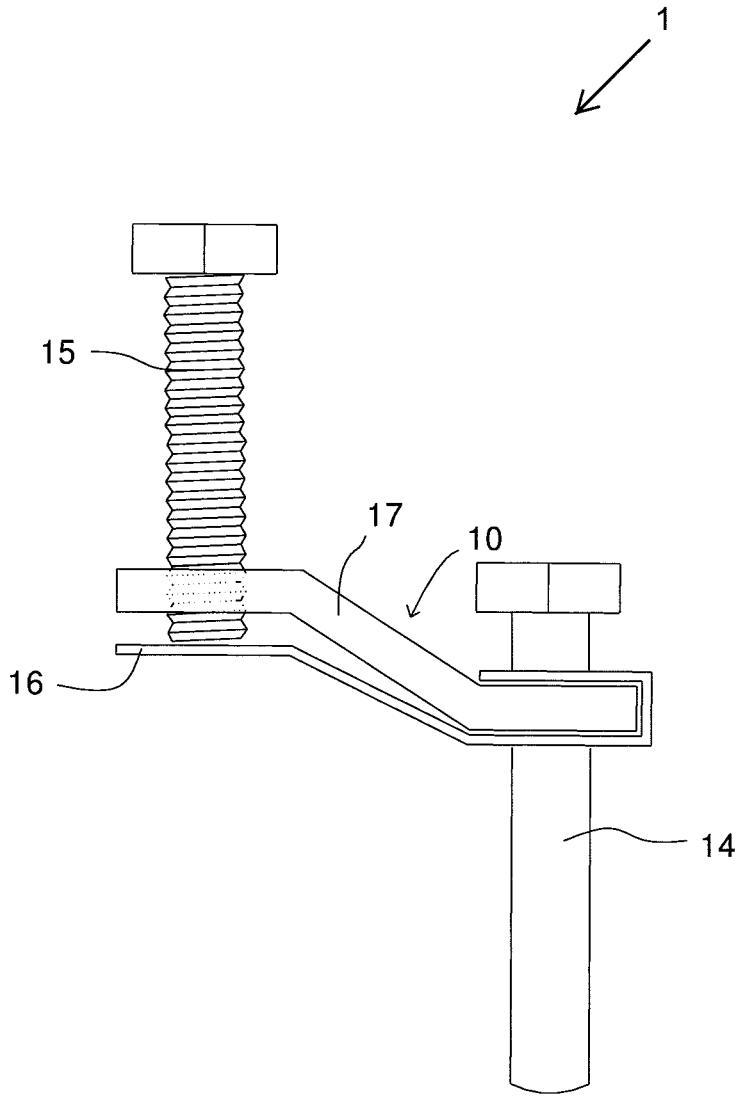

FIGS. 1A and 1B illustrate a clamping device 1 according to an embodiment. In an embodiment, the clamping device 1 includes a clamp 10, a binding post 14, and a clamp screw 15. The clamp 10 may further include a binding tab 16 and a clamp body 17 extending away from the binding post 14 at substantially a right angle to a lengthwise direction of the binding post. The clamp 10 is configured to apply force as described below.

Figure 2:
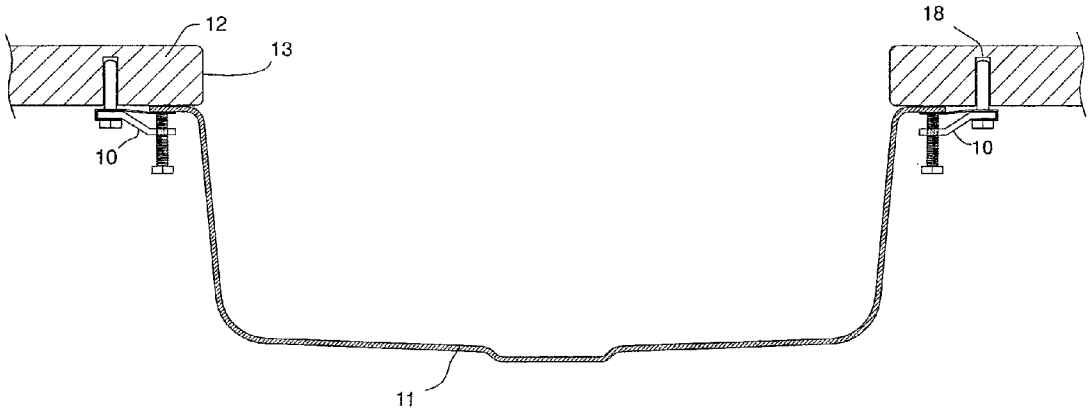
FIG. 2 is a partially-sectional side view of a sink attached to a counter surface utilizing the clamping devices of FIGS. 1A and 1B, in an embodiment.

FIG. 2 illustrates a sink 11, which may be positioned with sink opening 13, and attached to a lower/under surface (not numbered) of a countertop 12 by utilization of one or more of clamping devices 1. The countertop 12 may have at least one hole or a plurality of holes 18 drilled into the lower surface to receive the binding post 14 of a respective clamping device 1. Each hole 18 may be adjacent to a nearest edge of the sink 11. In an embodiment, a hole 18 may be ⅞" deep and ¼" diameter to accept an appropriately sized binding post 14. All or individual components of the clamping device 1 may be formed of rigid steel or plastic, or a material of sufficient strength to hold the sink 11 to the countertop 12 without breaking or separating. The binding tab 16 and/or clamp body 17 may be alternatively formed of spring steel, or another strong but flexible material. The binding post 14 may be made of a rigid material, such as steel, plastic, or a reinforced resin.

Figure 3:
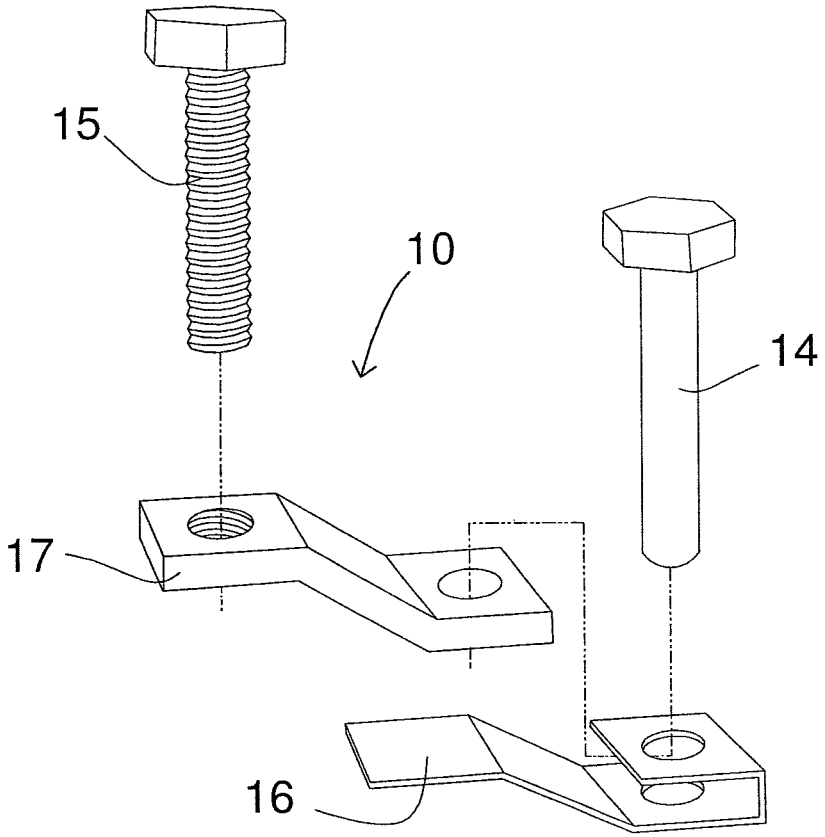
FIG. 3 is an exploded view of the clamping device of FIGS. 1A and 1B, in an embodiment.

FIG. 3 illustrates an exploded view of the clamping device 1 and respective individual elements that may complete one clamp, in an embodiment. In the example of FIG. 3, the clamp body 17, the binding tab 16, the binding post 14, and the clamp screw 15 can be seen as being the same as the respective elements illustrated in FIGS. 1A and 1B.

Figure 4:
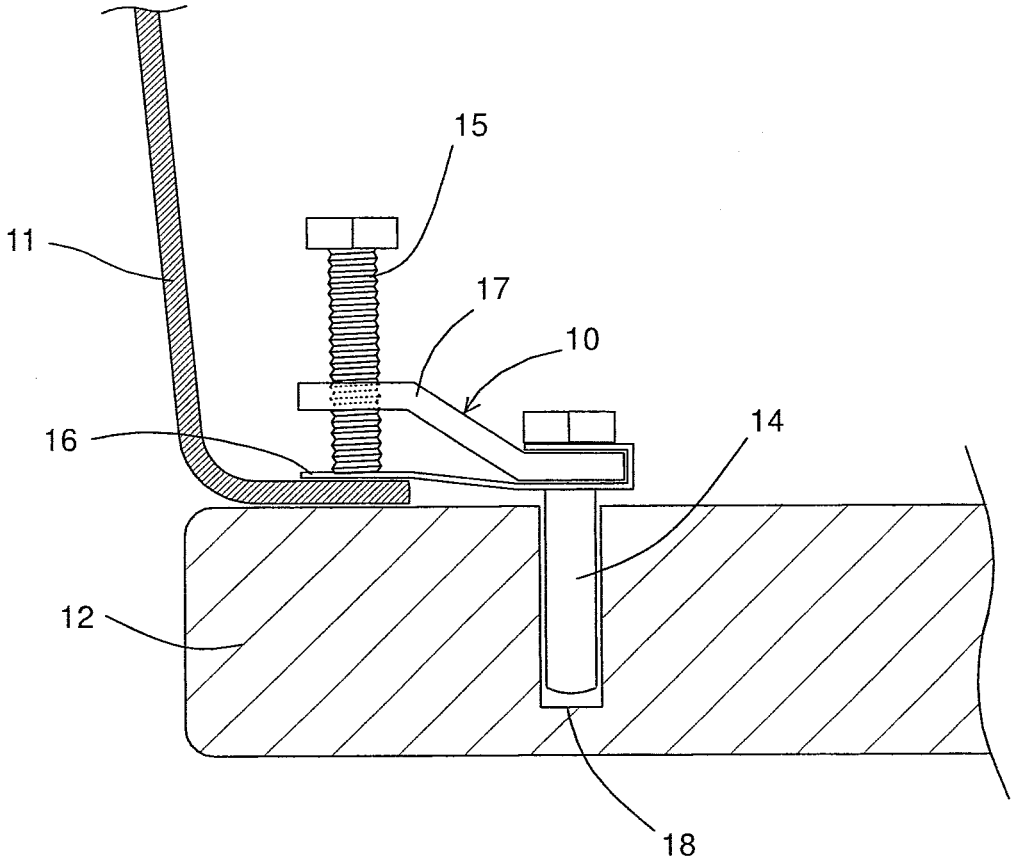
FIG. 4 is an enlarged portion of the partial sectional side view of the embodiment shown in FIG. 2.

FIG. 4 illustrates an enlarged portion of the partial sectional side view of the embodiment shown in FIG. 2. In the example of FIG. 4, the hole 18 may be drilled only part of the way into the countertop 12 from its underside. As best seen with respect to FIGS. 1A, 1B, and 3 as well, the binding post 14 may then be inserted into the hole 18 after passing through respective aligning holes (not numbered) in the binding tab 16 and the clamp body 17. In an embodiment, the binding tab 16 may wrap or fold around the clamp body 17 at one end thereof, to form two opposing holes about an aligning hole in the clamp body 17.

Once the binding post is so inserted into the hole 18, the clamp screw 15 may be inserted into a second hole (not numbered) at the other end of the clamp body 17, which itself may be positioned over a nearest edge of a rim (not numbered) of the sink 11. Once so positioned, the clamp screw 15 may be turned (typically clockwise) in the second hole, which may be threaded to correspond to the threading of the clamp screw, to enable the clamp screw to push an opposing end (not numbered) of the binding tab 16 down against the sink rim, causing the binding post 14 to bind in the hole 18 while simultaneously clamping the sink 11 to the countertop 12. The opposing end of the binding tab 16 may be solid, and need not include an additional opening corresponding to the clamp screw 15.

In use, the sink 11 may be positioned under the sink opening 13 (or to the underside of the countertop 12 if the countertop itself has not yet been installed to a counter) in the countertop 12. In an embodiment, countertop 12 may be made of granite or another hard surface material. The binding post 14 of each clamping device 1 may be received in a respective hole 18. The countertop 12 may include a plurality of holes 18 sufficient to hold the sink 11 securely to the countertop. After first passing through respective holes (not numbered) in the clamp body 17 and binding tab 16, the binding post 14 may be inserted into the hole 18. The corresponding holes in the binding tab 16, the clamp body 17, and the hole 18 may be sized slightly larger than an outer diameter of the binding post 14 (or width of the post, if the binding post is not circular in cross-section) to allow insertion thereof by minimal pressure. In an embodiment, the minimal pressure may be by hand, screwing action (if the post is threaded), or tapping from a hammer or mallet. In an embodiment, the binding post 14 may be held into place in the hole 18 by static friction from appropriate sizing of the hole 18 with respect to the binding post 14 or by inclusion of a wax coating on the binding post 14, which may allow additional friction between the binding post 14 and the hole 18, as best seen in FIG. 4.

Figure 5:
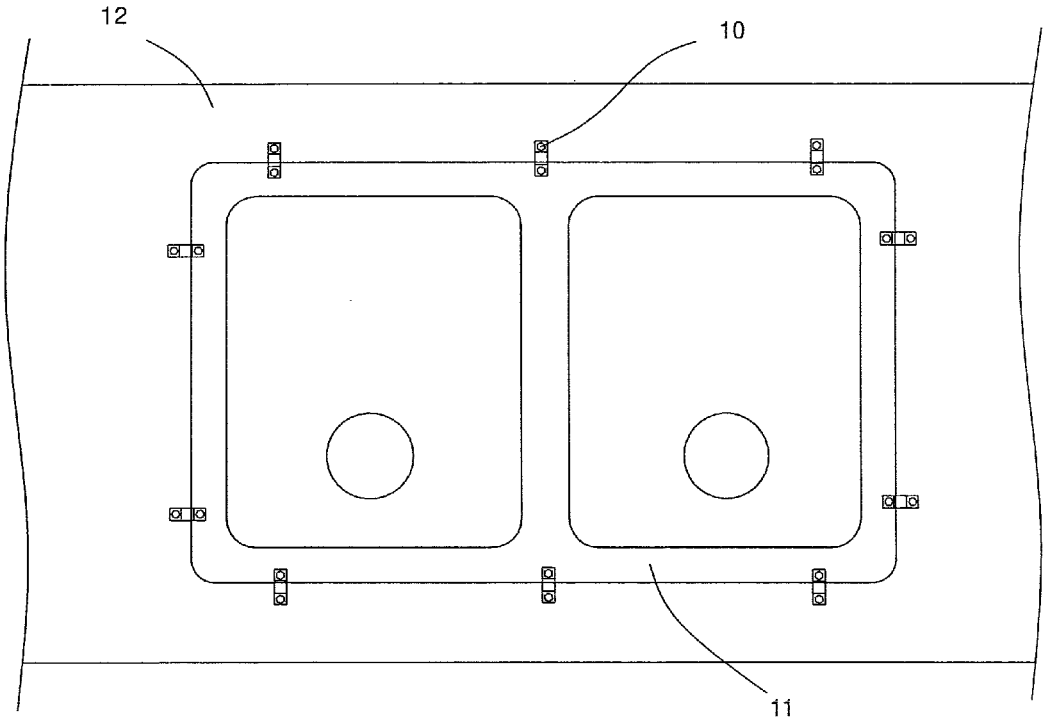
FIG. 5 is a underside view a sink attached to a counter utilizing the present clamping device, in an embodiment.

Referring now to FIG. 5, once the binding posts 14 are positioned in the respective holes 18, the clamping devices 1 may be distributed around the sink 11 to support the weight of the sink 11 on the respective clamp bodies 17. While the weight of the sink 11 is so supported by the clamp bodies 17, a fitter may be able to move the sink 11 on the clamping devices 1 to fit the sink 11 into a desired position about the sink opening 13. Once the sink 11 is in the desired position about the sink opening, the clamp screw 15 may be screwed into the opposing end of the clamp body 17 and tightened to pull the opposing end of the clamp body 17 away from the respective solid end of the binding tab 16 that presses against the edge of the sink 11. The tightening of the clamp screw 15 to separate the clamp body 17 and binding tab 16 at the opposing end of the clamp 10 will cause the first end of the binding tab 16 and clamp body 17 about the binding post 14 to securely pull against the binding post and thereby clamp the sink 11 to the work surface 12. In a fully-installed position, each clamping device 1 may be capable of carrying a significantly greater amount of weight placed on each clamp body 17. A shape of the clamp 10 allows the holding strength to become stronger when more pressure is exerted to the clamp screw 15 either by torque or by separation force between clamp 10 and work surface 12.

In an embodiment, the binding post 14 may have threads or ridges cut into it to allow for additional gripping friction within the hole 18. A wax or sacrificial substance may additionally be applied to the binding post 14 in this example to further aid the clamping device 1 to be pressure fitted with and into the hole 18. As best seen in FIGS. 1A and 1B, the opposing end of the clamp 10—including the clamp body 17 and binding tab 16—may be configured to accept sinks 11 of various edge thicknesses, or even a varying thickness around the edge of a single sink 11, without having to include additional parts to clamp the edge to countertop 12. The shape of the clamp 10 provides for a universal fitting. Additionally, according to an embodiment, the friction of the binding post 14 within the hole 18 may, when clamped, securely hold the sink 11 to the countertop 12 when the binding post 14 is fully inserted through the clamp 10 into the hole 18 (e.g., FIG. 1A), or when the binding post is only partially inserted through the clamp into the hole 18 (e.g., FIG. 1B). The binding post may thus be of sufficient length to allow for universal fitting to countertops of varied, or varying, thicknesses, without having to shorten the length of the binding post.

Other embodiments of the present clamping device are contemplated by the present inventor, including a clamp 10 without a binding tab 16, where the clamp body would serve as the entire clamp. In this example, the clamp screw 15 will press directly against the edge of the sink 11 when tightened, instead of the binding tab 16. The clamping device would otherwise function the same as described above. In another embodiment, a portion of the clamp body 17 may be configured to be formed at a substantially right angle to the clamp body 17 instead of the binding post 14.

In an embodiment, the sink 11 may be installed to a countertop 12 utilizing the clamping device 1 according to the following steps. The countertop 12 may first be placed bottom side up on a workbench (not shown), for easier access to a fitter. Where the countertop is made of a very heavy and hard material such as granite, it may be particularly advantages to work on the bottom side from above the countertop 12 prior to its installation to a counter. The sink 11 may then be placed substantially into position on the bottom side of countertop 12. A mark may then be placed on the countertop 12 at a desired position of the aligning holes about the binding post 14 of each clamping device 1 about the edge of the sink 11. In an embodiment, the respective marks may be approximately ½" from the edge of sink 11. The holes 18 may then be drilled at each of the marks to receive the respective binding posts 14. In an embodiment, the holes may be ¼" in diameter and ⅞" deep into a thickness of the countertop 12. In an embodiment, the holes 18 do not pass all the way through the countertop 12. The countertop 12 may then be installed onto cabinets of a counter by conventional methods.

Alternatively, the countertop 12 is installed onto cabinets prior to attachment of the sink 11, and the sink 11 is fitted to the countertop from the underside through use of the same clamping devices 1. Prior to attachment of the sink 11 to the countertop 12, a bead of silicone (or other sealant) may be placed on a rim of sink 11 facing the countertop 12. The sink 11 may then be placed into a desired position beneath the countertop 12 as described above. In an embodiment, the sink 11 may be held into position against the countertop 12 temporarily by conventional means (now shown). In an embodiment, a nut driver may be placed onto the head of the binding post 14, to then drive the binding post 14 through the respective clamp 10 into the respective hole 18. In this example, the holes 18 may be marked and created according to the same steps described above. Once the binding post 14 is so inserted into the hole 18, the opposing end of the clamp 10 may be positioned against the rim about the edge of the sink 11 until the respective binding tab 16 makes contact with sink 11. Before tightening the clamp screw 15, final positioning of the sink 11 may be performed as described above. Once the sink 11 is so in the final desired position, each clamp 10 may be tightened by turning clamp screw 15 until secure against the respective binding tab 16. In an embodiment, the clamp screw can be configured to tighten in a clockwise direction, and may include a hexagonal head (not numbered) that may be turned using a conventional nut driver. When so tightened, the plurality of clamping devices 1 about the sink 11 will securely attach the sink 11 to the countertop 12.

In an embodiment, the clamping device 1 may be preassembled, such that the binding post 14, clamp screw 15, binding tab 16, and clamp body 17 are loosely fitted together to only require insertion of the binding post into a respective hole 18 and tightening of the clamp screw 15. Alternatively, the binding post 14 may be a separate piece from the preassembled clamping device 1 for easy marking of the underside of the countertop 12. By these configurations, the present embodiments eliminate the need to inventory and keep track of various parts (e.g., flat clips, nuts, inserts, studs, washers, etc.) conventionally needed to attach an article, such as a sink, to a surface.

Furthermore, due to the often very crowded and limited work space available under a kitchen sink, including but not limited to plumbing supply lines and drains, it is conventionally very difficult to use two hands when installing under counter sinks from below, even though use of both hands is typically required in such conventional installations. According to the present embodiments, however, the present clamping devices and methods may be fully implemented through one-handed installation, which greatly simplifies the installation of an under counter sink from below.

Another advantage to the present embodiments is that no special tooling is required to complete a sink installation. The only tooling required to accomplish the steps described above may be a standard drill having a masonry percussion drill bit or a diamond non-coring drill bit (if the countertop 12 is made of a hard stone material such as granite, for example). Use of a relatively small diameter for the hole 18, as described above, also allows for very fast and economical drilling.

According to the present embodiments described herein, the clamping device 1 may be configured such that, once the device is installed, the greater the separating force that can be achieved between the sink 11 and the countertop 12, the higher the holding power that will be realized by the device. One of ordinary skill in the art will further appreciate, after reading and comprehending the present disclosure, that a clamping device according to the present embodiments will further allow a sink that is installed as described above to be more easily removed than can be conventionally accomplished, at a later time if desired, and without risking the countertop to damage from the removal.

Changes may be made in the above methods and systems without departing from the scope hereof The present inventor further contemplates that the many features disclosed herein may be used together or in combination with the other features disclosed among the several embodiments of the invention. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

I claim:

1. A clamping device for mounting a sink to a countertop, comprising:

a clamp including a clamp body and a binding tab;

a binding post for insertion through a first opening in the clamp body and into a hole in a surface of the countertop adjacent to the sink, the clamp and binding tab connected to the post and extending away therefrom at least partially over an edge of the sink; and a clamp screw for insertion through a second opening in the clamp body and against a solid portion of the binding tab interposed between the clamp screw and the edge of the sink.

2. The device of claim 1, wherein the clamp body and binding tab comprise a single, unitary body for the clamp.

3. The device of claim 1, wherein the clamp body and binding tab are separate elements, detachable from one another.

4. The device of claim 1, wherein the clamp is formed of rigid steel.

5. The device of claim 1, wherein the clamp is formed of spring steel.

6. The device of claim 1, wherein the binding post is formed of rigid material comprising at least one of steel, plastic, and reinforced resin.

7. The device of claim 1, wherein the binding post further comprises a wax coating.

8. The device of claim 1, wherein the binding post further comprises at least one of threading and ridges.

9. The device of claim 8, wherein the hole includes threading that accommodates the threading of the binding post.

10. The device of claim 1, wherein the hole is configured to be slightly larger than an outer width of the binding post to accommodate the binding post securing to the hole by static force.

11. The device of claim 1, wherein the clamp is angled along a lengthwise direction to accommodate a thickness of the edge of the sink.

12. The device of claim 11, wherein at least one angle of the clamp along the lengthwise direction is ninety degrees.

13. A counter system, comprising:

a countertop;

a sink configured to fit with an opening of the countertop; and a clamping device for attaching the sink to the countertop, the clamping device including:

a clamp including a first opening and a second opening along a lengthwise direction of the clamp separate from one another;

a binding post for insertion through the first opening and into a hole in a surface of the countertop adjacent to the sink; and a clamp screw for insertion through the second opening in the clamp and against the edge of the sink.

14. The system of claim 13, wherein the clamp further comprises a clamp body and a binding tab separate and distinct from the clamp body.

15. The system of claim 14, wherein a solid portion of the binding tab is positioned between the clamp screw and the edge of the sink.

16. A method of installing a sink to a countertop, comprising the steps of:

forming an opening in the countertop corresponding to a shape of an outer edge of the sink, the opening being smaller than a perimeter of the outer edge of the sink;

positioning the sink about the opening in the countertop;

drilling a plurality of holes at least partially through a thickness the countertop, the plurality of holes located adjacent to but outside of the perimeter of the outer edge of the sink;

locating a respective first open portion of a first end of each of a plurality of clamps about each of the plurality of holes;

inserting a binding post through each clamp first end open portion and respective hole to hold the sink against the countertop;

threading a plurality of clamp screws into a respective second open portion of each of the plurality of clamps, each of the second open portions being disposed on the outer edge of the sink; and tightening each of the plurality of clamp screws against the outer edge of the sink to securely install the sink against the countertop.

17. The method of claim 16, further comprising a step of, prior to the step of locating, placing a bead of sealant around the edge of the sink adjacent the perimeter.

18. The method of claim 17, wherein the sealant comprises silicone.

* * * * *